US007028924B2

(12) United States Patent
Palle et al.

(10) Patent No.: US 7,028,924 B2
(45) Date of Patent: Apr. 18, 2006

(54) SPRINKLER NOZZLE FOR SPREADING OF SMALL DROPS OF WATER

(75) Inventors: Carsten Palle, Haarby (DK); Søren Hansen, Odense (DK)

(73) Assignee: GW Sprinkler A/S, Glamsbjerg (DK)

( * ) Notice: Subject to any disclaimer, the term of this patent is extended or adjusted under 35 U.S.C. 154(b) by 143 days.

(21) Appl. No.: 10/451,799

(22) PCT Filed: Jan. 14, 2002

(86) PCT No.: PCT/DK02/00021

§ 371 (c)(1),
(2), (4) Date: Dec. 29, 2003

(87) PCT Pub. No.: WO02/055208

PCT Pub. Date: Jul. 18, 2002

(65) Prior Publication Data

US 2004/0089736 A1 May 13, 2004

(30) Foreign Application Priority Data

Jan. 15, 2001 (DK) ..... 2001 00058

(51) Int. Cl.
*B05B 1/26* (2006.01)
*B05B 1/34* (2006.01)
*A62C 31/00* (2006.01)

(52) U.S. Cl. ..... 239/461; 239/469; 239/476; 239/479; 239/480; 239/482; 239/548

(58) Field of Classification Search ..... 239/461, 239/469, 476, 479, 480, 482, 533.12, 548, 239/558, 567; 169/37, 41, 42
See application file for complete search history.

(56) References Cited

U.S. PATENT DOCUMENTS

| | | | | |
|---|---|---|---|---|
| 2,701,165 A | | 2/1955 | Bete et al. | 299/129 |
| 3,802,510 A | * | 4/1974 | Johnson | 169/19 |
| 4,208,359 A | | 6/1980 | Bugler, III et al. | 261/111 |
| 4,653,693 A | | 3/1987 | Steingass | 239/460 |
| 4,700,893 A | * | 10/1987 | Bugler, III | 239/498 |
| 6,345,670 B1 | | 2/2002 | Sundholm | 169/37 |
| 6,347,669 B1 | * | 2/2002 | Sundholm | 169/37 |

FOREIGN PATENT DOCUMENTS

| | | |
|---|---|---|
| DE | 26 49 977 | 5/1978 |
| DE | 200 02 324 | 6/2000 |
| DE | 299 22 673 | 9/2000 |
| WO | 92/19383 | 11/1992 |

* cited by examiner

*Primary Examiner*—Davis Hwu
(74) *Attorney, Agent, or Firm*—Jacobson Holman PLLC

(57) ABSTRACT

A sprinkler nozzle having a nozzle housing with an inlet for liquid and having a longitudinally extending axis. The nozzle housing, opposite the inlet, is delimited by a surface of revolution with nozzle outlet openings arranged around the axis. In the flow direction opposite the nozzle outlet openings, respective impact faces are arranged for reflecting the liquid that flows out through the nozzle outlet openings. The impact faces are constituted by the ends of respective threads that are secured to the nozzle housing, whereby the impact faces are able to reflect water that flows out of the respective nozzle outlet openings.

20 Claims, 3 Drawing Sheets

SPRINKLER NOZZLE FOR SPREADING OF SMALL DROPS OF WATER

BACKGROUND OF THE INVENTION

1. Field of the invention

The invention relates to a sprinkler nozzle of the kind having a sprinkler housing with an inlet for liquid and with a longitudinally extending axis, the nozzle housing opposite the inlet being delimited by a surface of revolution with nozzle outlet openings arranged around the axis and wherein, opposite the mouth of the nozzle outlet openings, respective impact faces are arranged for the liquid that flows out through the nozzle outlet openings. Such a sprinkler nozzle is known from DE-U-200 02 324, which is incorporated herein in its entirety by the present reference.

2. Description of the Related Art

Water in the form of small droplets has proven to be an effective way of extinguishing fires by permanently installed equipment, since the small water small droplets evaporate easily and thus provide a high degree of cooling and large amounts of inactive water vapour.

Most prior art systems form small droplets by conveying highly pressurised water (50–200 bar) through nozzle outlet openings in a nozzle housing. A few other systems form small droplets by conveying water through a venturi opening or by causing two water jets to hit each other.

Nozzles are also known, wherein a water jet hits an impact face and wherein the water reflected from the impact face is hit by a second water jet. Such nozzles are primarily intended for reducing the amount of dust contained in the air and have no optimised construction to enable them to be used as permanently installed fire-extinguishing nozzles, including use as automatically released fire extinguishing nozzles. One example of such nozzle is shown in U.S. Pat. No. 2,701,165, wherein the nozzle has a single nozzle outlet opening that extends centrally in extension of the longitudinal axis of the nozzle housing, and wherein the end of a thread is situated opposite the mouthing of the nozzle outlet opening. DE-A-26 49 977 teaches another example, wherein a nozzle housing with a number of nozzle outlet openings has a disc-shaped plate located in front of it that forms an impact face for liquid that flows through each of the nozzle outlet openings. This construction is inconvenient due to the disc-shaped plate shielding against the liquid thus transformed into small droplets. Thereby the nozzle will not be suitable for extinguishing fires, since liquid dispersed to small droplets will not flow to the area centrally in front of the nozzle. Both U.S. Pat. No. 2,701,165 and DE-A-26 49 977 are incorporated herein in their entirety by the present reference.

SUMMARY OF THE INVENTION

The present invention enables manufacture of a very compact sprinkler nozzle that can advantageously be used at low supply pressures and is particularly suitable for extinguishing fires. Use of the nozzle provides a homogeneous flow of water small droplets across a relatively large circular area around the sprinkler nozzle, and the sprinkler nozzle can particularly advantageously be located in a vertical, downwardly oriented position. The invention enables adequate control of the distribution pattern of water small droplets and by the invention it is now possible to manufacture an improved, automatically released nozzle. According to one embodiment of the invention, the nozzle housing is protected by a protective jacket that is automatically detached when the nozzle is activated.

In the following, the invention will be explained in further detail with reference to the two exemplary embodiments shown in the drawing.

DETAILED DESCRIPTION OF THE PREFERRED EMBODIMENTS

Figure 1A:
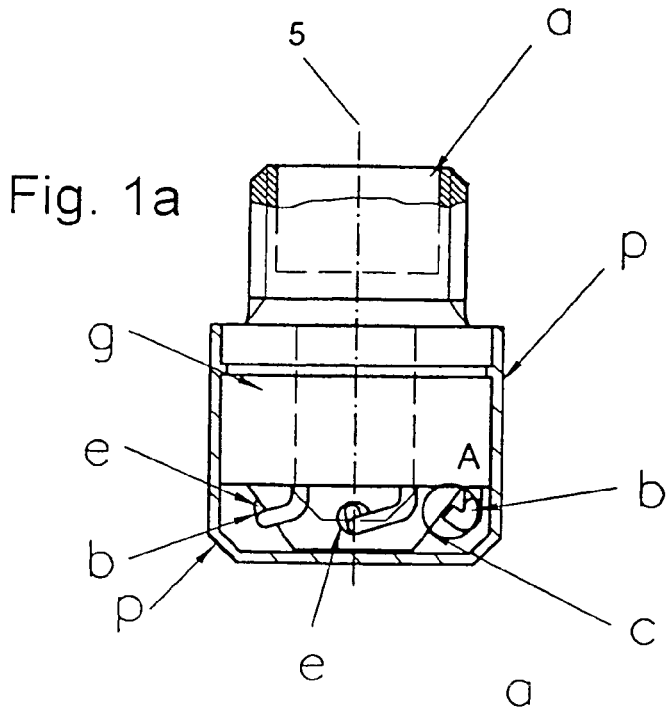
FIG. 1*a* shows a first embodiment of the invention in a partially sectional view.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The sprinkler nozzle according to the invention comprises a nozzle housing g with a longitudinal axis 5 and is intended for dispersing water in the form of water small droplets. The nozzle housing g has an inlet a and a number of nozzle outlet openings b that are evenly distributed on a surface of revolution c, eg a conical face, that forms a wall opposite the inlet a. The drawing shows an exemplary embodiment with three nozzle outlet openings b located at the same level relative to the longitudinal axis 5 and with a mutual angular distance of 120°.

The nozzle outlet openings b are configured as bores with a preferably circular cross section through the wall c, and the bores extend at an angle d relative to the longitudinal axis 5 of the nozzle housing, wherein the angle d is 45°+/−10°, or between 15° and 60°. Hereby the liquid through the nozzle outlet openings b will be oriented in accordance with the angle d. The face c is, as shown, preferably a wall that has been produced, geometrically, by revolving a curve about the longitudinal axis 5.

Centrally in front of each nozzle opening b a face e is located having an area that may be equal to or smaller than the area of the associated nozzle outlet opening b. Of the liquid that leaves the nozzle outlet opening b, a first liquid portion hits the face e and is reflected back, whereas the remainder of the liquid flows past the face e. When the reflected liquid hits the remainder of the liquid, a total flow of very small water small droplets is provided from the sprinkler nozzle, as outlined in FIG. 1*b*.

The face e is typically positioned at a distance from the mouthing of the nozzle outlet opening b, corresponding to 1–5 times the diameter of the face e. The face e is preferably constituted by the end of a thread f that is secured to the nozzle housing g and has a desired rigidity, whereby the location of the end face e becomes well-defined. The cross section of the thread f is preferably circular, and the face e is preferably flat and extends perpendicular to the longitudinal axis of the thread, as shown in FIG. 1*b*. As shown in FIG. 1*c*, the thread f is preferably bent in two places, whereby it is possible to secure the thread to the nozzle housing g at a relatively large distance from the nozzle outlet b. In this manner liquid that hits the end face e is reflected in all directions around the end face e and flows uninterruptedly back in the direction of the nozzle outlet opening b. If the nozzle outlet opening b is configured as a bore with a circular cross section through the wall c, and when the face e also has a circular shape, the ratio × between the diameter of the face e and the diameter of the nozzle outlet opening b may be $0.5<x<2$.

Figure 1B:
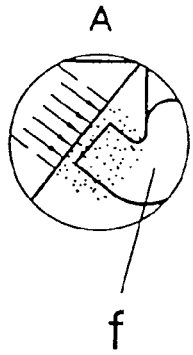
FIG. 1*b* is an enlarged sectional view of the FIG. 1*a* embodiment at the area A.
Figure 2B:
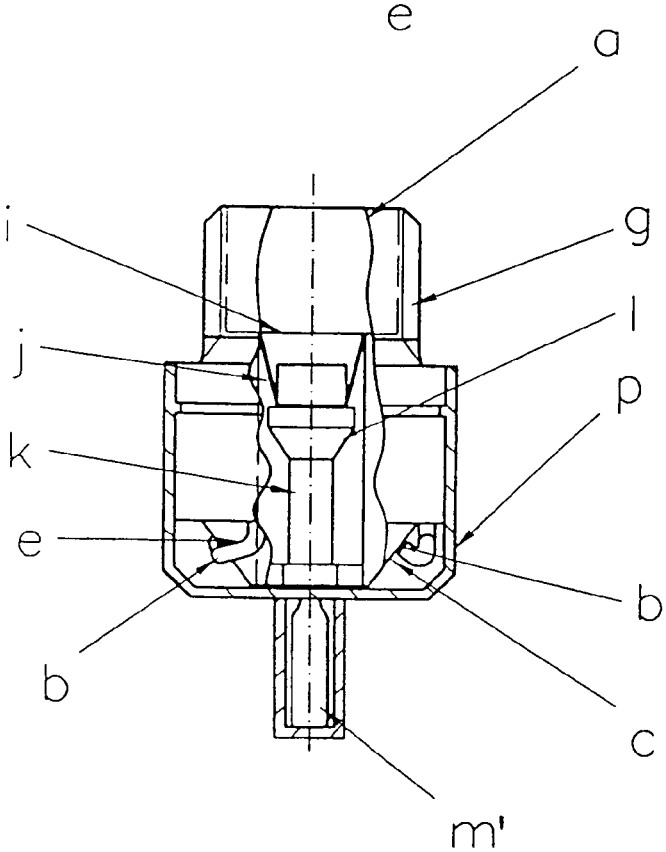
FIG. 2*b* shows the FIG. 2*a* embodiment in a partial sectional view.
Figure 2A:
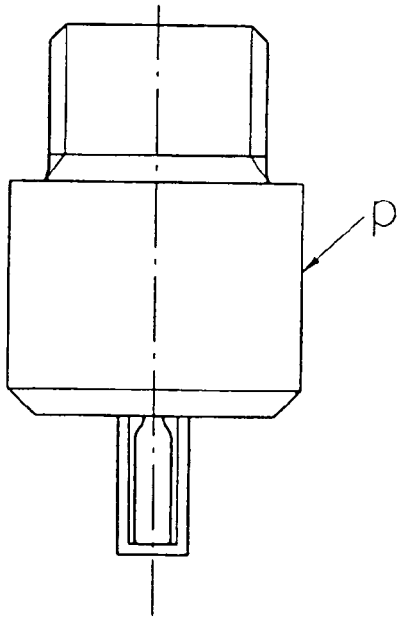
FIG. 2*a* shows a second embodiment of the invention.
Figure 1C:
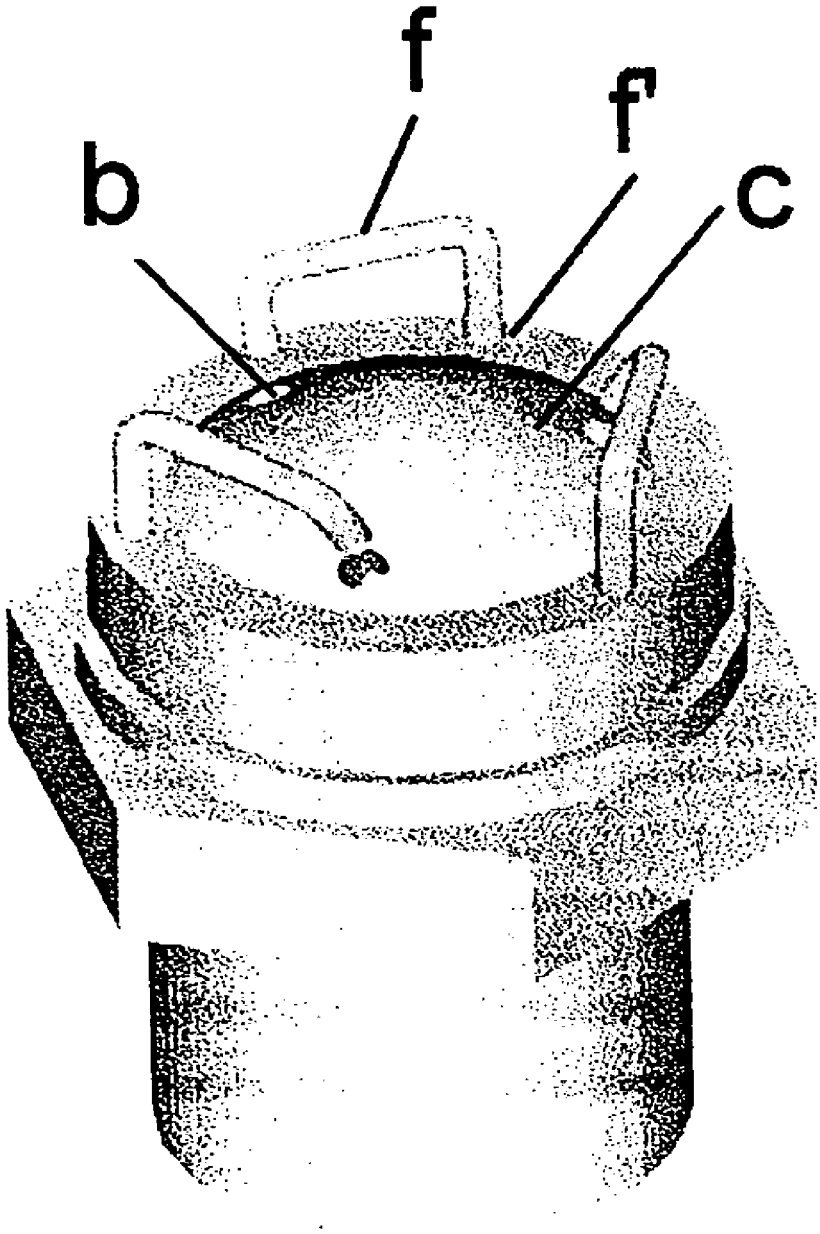
FIG. 1*c* is a schematically view of the end area of the sprinkler nozzle shown in FIG. 1*a* in a perspective view.
Figure 2C:
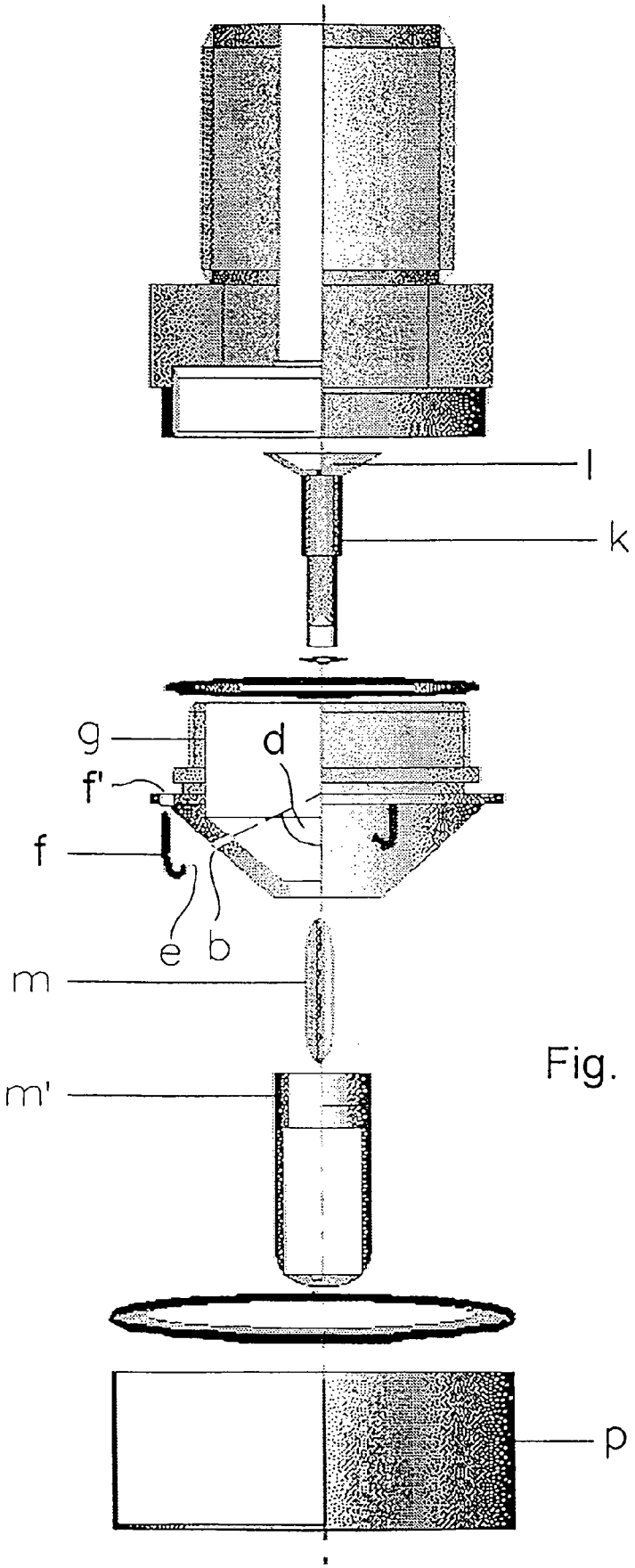
FIG. 2*c* is an exploded, partially sectional view of the embodiment shown in FIGS. 2*a–b*.

A variety of the nozzle shown in FIGS. 1*a–b* comprises, as shown in FIGS. 2*a–c,* automatic release. This nozzle is released by heat influence or by electrical influence. Internally in the nozzle, a seat is provided in the inlet area i, a gasket j abuts on the seat i. The gasket j is kept in place against the seat by a piston k. The piston has a conical abutment or sealing face J. The piston is kept in place by a heat sensitive element m, such as a glass ampoule, a melting joint, a piece of bimetal or a memory alloy. The heat sensitive element m is kept in place by a yoke m' that is secured to the nozzle housing g.

The sprinkler nozzle operates as follows: Water from the water supply flows in through the inlet a and out through the nozzle outlet openings b. Here some of the water hits the face e that reflects the water. The reflected water is hit by the remainder of the water through the nozzle outlet openings b. The collision between the two flows of water divides the water into water small droplets. The angle d at which the nozzle outlet openings b is located determines the distribution pattern. The clearance width of the nozzle outlet opening b and the diameter of the face e determines the amount of water distributed and the size of the individual drops. In case of automatically released nozzles a heat influence from the fire causes the heat-sensitive element to burst (glass ampoule) or collapse. Hereby the support of the piston disappears and the supply pressure is able to press the gasket away from the seat and the abutment or sealing face towards the opening periphery of the piston. Hereby water is allowed to pass through the nozzle and out through the open nozzle outlet openings b, the nozzle being until then proof against leakage from the piston opening. The nozzle can be provided with a protective jacket p that is automatically pressed off by the water when the nozzles are activated.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A sprinkler nozzle comprising a nozzle housing with an inlet for liquid and with a longitudinally extending axis, said nozzle housing, opposite the inlet, being delimited by a surface of revolution with nozzle outlet openings arranged around the axis, a plurality of impact faces respectively arranged opposite and proximate to mouths of the nozzle outlet openings so as to reflect the liquid that flows out through the nozzle outlet openings back toward said nozzle outlet openings to create small droplets of liquid said impact faces being constituted by the ends of respective threads that are secured to the nozzle housing.

2. The sprinkler nozzle according to claim 1, wherein the nozzle outlet openings are configured in the surface of revolution such that the outflow of liquid extends in a direction relative to the longitudinal axis of the nozzle housing of 45°, +/−10°.

3. The sprinkler nozzle according to claim 1, wherein at least three nozzle outlet openings are arranged around the axis at the same level and at the same angular distance relative to each other.

4. The sprinkler nozzle according to claim 1, wherein the surface of revolution defines a spherical shell or a cone.

5. The sprinkler nozzle according to claim 1, wherein the threads include two bends and are secured in respective places that are located at a distance from the nozzle outlet opening and symmetrically around the axis.

6. The sprinkler nozzle according to claim 1, wherein a heat sensitive element extends along the longitudinal axis for releasing the sprinkler nozzle by the influence of heat.

7. The sprinkler nozzle according to claim 1, wherein a detachable protective jacket is arranged to cover the nozzle housing opposite the inlet.

8. The sprinkler nozzle according to claim 1, wherein the impact faces are located centrally in front of each nozzle outlet opening, each face having an area that is equal to or smaller than the area of the associated nozzle outlet opening.

9. The sprinkler nozzle according to claim 1, wherein each impact face is generally parallel with the surface of revolution such that the flow of liquid through the nozzle outlet openings is generally perpendicular to said impact faces.

10. The sprinkler nozzle according to claim 1, wherein a distance between the impact faces and the mouths of the nozzle outlet openings is about 1–5 times a diameter of said impact faces.

11. A sprinkler nozzle comprising a nozzle housing with an inlet for liquid and a longitudinally extending axis, said nozzle housing, opposite the inlet, having a plurality of nozzle outlet openings arranged around the axis, a plurality of impact faces respectively located centrally in front of said nozzle outlet openings to reflect at least a portion of the liquid that flows out through the nozzle outlet openings back toward said nozzle outlet openings to create small droplets of liquid, each of said impact faces being constituted by the end of a respective thread that is secured to the nozzle housing.

12. The sprinkler nozzle according to claim 11, wherein the nozzle outlet openings are configured such that the outflow of liquid extends in a direction relative to the longitudinal axis of the nozzle housing of 45°, +/−10°.

13. The sprinkler nozzle according to claim 11, wherein the impact faces are generally perpendicular to the flow of liquid through said nozzles.

14. The sprinkler nozzle according to claim 11, wherein each impact face has an area that is equal to or smaller than the area of the associated nozzle outlet opening.

15. A sprinkler nozzle comprising a nozzle housing with an inlet for liquid and a longitudinally extending axis, said nozzle housing, opposite the inlet, being delimited by a surface of revolution with a plurality of nozzle outlet openings arranged around the axis and configured in said surface of revolution such that the outflow of liquid extends in a direction relative to the longitudinal axis of the nozzle housing of 45°, +/−10°, a plurality of impact faces respectively positioned opposite the mouths of the nozzle outlet openings so as to reflect at least a portion of the liquid that flows out through the nozzle outlet openings back toward said nozzle outlet openings to create small droplets of liquid through said reflection and resulting collision of liquid particles.

16. The sprinkler nozzle according to claim 15, wherein each of the impact faces is constituted by the end of a respective thread that is secured to the nozzle housing.

17. The sprinkler nozzle according to claim 16, wherein the impact face is generally parallel with the surface of revolution such that the flow of liquid through the nozzle outlet openings is generally perpendicular to said impact face.

18. The sprinkler nozzle according to claim 15, wherein each impact face has an area that is equal to or smaller than the area of the associated nozzle outlet opening.

19. The sprinkler nozzle according to claim 15, wherein the impact faces are respectively located centrally in front of each nozzle outlet opening.

20. The sprinkler nozzle according to claim 15, wherein the surface of revolution defines a spherical shell or a cone.

* * * * *